United States Patent [19]

Hackmack

[11] Patent Number: 4,852,946

[45] **Date of Patent: * Aug. 1, 1989**

[54] SURFACE WORKING ACCESSORY AND METHOD

[76] Inventor: Alfred Hackmack, Am Deich 30, D-2095 Obermarschacht, Fed. Rep. of Germany

[ * ] Notice: The portion of the term of this patent subsequent to Aug. 2, 2005 has been disclaimed.

[21] Appl. No.: 126,360

[22] Filed: Nov. 30, 1987

Related U.S. Application Data

[63] Continuation of Ser. No. 483,494, Apr. 11, 1983, Pat. No. 4,761,038.

[30] Foreign Application Priority Data

Apr. 15, 1982 [DE] Fed. Rep. of Germany ..... 3213898

[51] Int. Cl.[4] ..... E01C 23/09

[52] U.S. Cl. ..... 299/10; 299/39; 404/90

[58] Field of Search ..... 299/10, 39, 40, 41, 299/76; 404/90, 91, 92; 37/91, 94, 117.5; 172/4, 5

[56] References Cited

U.S. PATENT DOCUMENTS

| | | | |
|---|---|---|---|
| 2,912,232 | 11/1959 | Lewis | 299/39 |
| 3,785,705 | 1/1974 | Binger et al. | 299/75 |
| 3,975,055 | 8/1976 | Wirtgen | 299/39 |
| 4,023,288 | 5/1977 | Roe | 37/117.5 |
| 4,100,688 | 7/1978 | Grist | 37/117.5 |
| 4,103,973 | 8/1978 | Cutler | 299/39 |
| 4,134,459 | 1/1979 | Hutchen | 173/32 |
| 4,262,966 | 4/1981 | Bouplon | 299/39 |
| 4,278,368 | 7/1981 | Livesay | 404/117 |
| 4,387,929 | 6/1983 | Wirtgen | 299/39 |
| 4,411,081 | 10/1983 | King | 37/117.5 |
| 4,761,038 | 8/1988 | Hackmack | 299/10 |

FOREIGN PATENT DOCUMENTS

| | | |
|---|---|---|
| 296980 | 6/1985 | Denmark . |
| 2040890 | 6/1977 | Fed. Rep. of Germany . |
| 2741114 | 3/1978 | Fed. Rep. of Germany . |
| 2901788 | 7/1980 | Fed. Rep. of Germany . |
| 1590110 | 5/1970 | France . |

OTHER PUBLICATIONS

RayGo brochure, "Barco Mill 100A Parts Book", Apr. 1981.

RayGo Handbook, "A Guide to Small Scale Pavement Maintenance", Jun. 1982.

*Primary Examiner*—Jerome W. Massie, IV
*Assistant Examiner*—David J. Bagnell
*Attorney, Agent, or Firm*—Thomas L. Adams

[57] ABSTRACT

An accessory for the boom of road working equipment has a frame arranged for attachment to the boom. The accessory also has a shaft rotatably mounted in the frame. Also included is a motor mounted on the frame for rotating the shaft. The accessory employs a rotary tool mounted on the shaft.

21 Claims, 2 Drawing Sheets

SURFACE WORKING ACCESSORY AND METHOD

This is a continuation of application Ser. No. 483,494 filed 4/11/83 now U.S. Pat. No. 4,761,038.

BACKGROUND OF THE INVENTION

The present invention relates to a combination road planing—joint cutting attachment for hydraulic excavators, backhoe loaders, loading shovels and the like.

On almost every utility and road building site there is an excavator or backhoe loader or a loading shovel. Often these machines stand idle because they are not needed all the time on the site. Road builders usually have their excavators, backhoe loaders and/or loading shovels present when repairing pot-holes when, patching a road surface, when cutting joints on bridges, when making demarcations, and when milling joints on those spots where old and new layers meet (for instance, on crossings where one street gets a new layer and the crossing street does not; so that bumps can be avoided by vehicles driving over this joint). These jobs often require a known self-propelled road planer and/or road planer attachment. Also known are self-propelled joint cutters with diamond blades. Bringing all of these various machines to a work site can be strategically difficult and will involve a large capital investment. Even when a large number of machines are marshalled, the commercially available joint cutters and road planers often cannot work around commonly occurring obstructions.

Utility contractors with such equipment must often cut two joints in the road surface, then dig a trench, lay pipe, refill the trench, bring in the base course, mill on the edges of the joints 10–20 cm wide 2–3 cm deep in order to get a better connection between the old and the new layer, and then put in the wearing course. This, again, involves a myriad of expensive and often ineffective machines.

Cable contractors often cut two joints in foot-paths. Many foot-paths have only a thin wearing course of about 2 cm. Beneath this wearing course is a base course of 8–10 cm. It would be desirable to remove the base and wearing course with a planer. However, this is not possible with road planers which are on the market. Small road planers have insufficient power to perform this job. Bigger road planers cannot drive on foot-paths because there is not enough room or because they are too heavy and would damage the wearing course. In any event, after removing these courses a trenching device is often used where the asphalt has been removed to do the appropriate trenching.

Accordingly, there is a need to reduce the number of machines required at a work site with a powerful but lightweight accessory that can avoid obstructions and can reduce the number of passes needed to complete certain tasks.

SUMMARY OF THE INVENTION

In accordance with the illustrative embodiment demonstrating features and advantages of the present invention, there is provided an accessory for the boom of ground working equipment. The accessory has a frame arranged for attachment to the boom; also, a shaft is rotatably mounted in the frame. The accessory also includes a motor mounted on the frame for rotating the shaft. Also included is a rotary tool mounted on said shaft.

Also in accordance with the same invention, there is provided a method for using a rotary tool on a boom of ground working equipment which has a power source. The method includes the step of rotatably attaching the rotary tool to the boom. Another step is rotating the tool with power from the power source. Another step of the method is adjusting the boom to press the tool against a ground surface.

By employing such accessories and methods improved ground working is achieved. In a preferred embodiment the equipment has the combination of a joint cutter with a disc with carbide tipped tools and a road planer in one equipment; as an attachment which will be fixed to the boom of a hydraulic excavator or the boom of a backhoe loader or the arms of a loading shovel. With this equipment now each hydraulic excavator, backhoe loader and loading shovel can be used as road planer or as joint cutter. By this equipment the excavator, backhoe loader and loading shovel become more versatile for the user. Instead of the usual idle times, these machines can now with the here described equipment cut joints or plane roads. With a trencher device fixed to the equipment there can also be done trenching work on this site.

Road builders can use their excavators, backhoe loaders and loading shovels with the here described equipment for repairing pot-holes and patches in the road surface, for cutting joints on bridges, for demarcation, for milling joints on those spots where old and new layers meet (for instance, milling on crossings where one street gets a new layer and the crossing street does not, so that bumps can be avoided on vehicles driving over this joint).

On account of the fact that excavators and backhoe loaders can work with their booms across obstacles it is now possible with the here described attachment to do joint cutting and milling where until now road planers and joint cutters could not get. Apart from the technical advantages, the user of the here described equipment saves the capital investment for buying two or 3 three much more expensive machines.

BRIEF DESCRIPTION OF THE DRAWINGS

The above brief description as well as other objects features and advantages of the present invention will be more fully appreciated by reference to the following detailed description of a presently preferred but nonetheless illustrative embodiment in accordance with the present invention when taken in conjunction with the accompanying drawings wherein.

DETAILED DESCRIPTION OF THE PREFERRED EMBODIMENT

Figure 1:
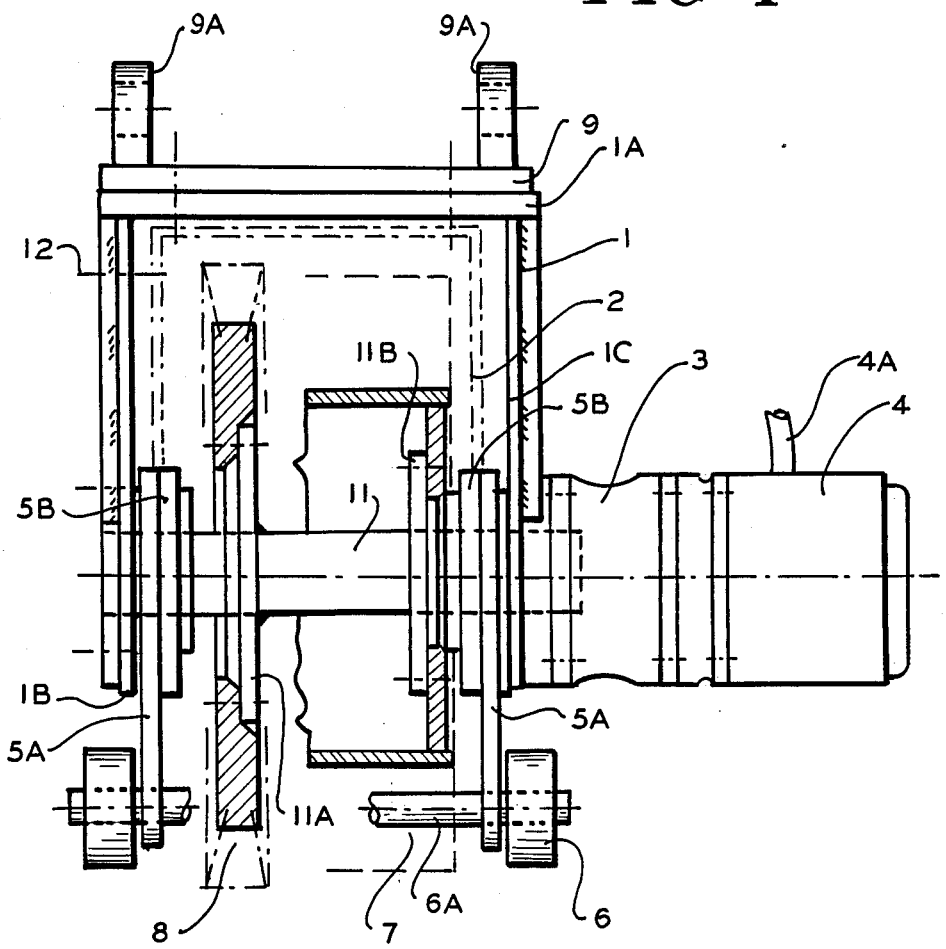
FIG. 1 is an elevational end view of an accessory according to the principles of the present invention.
Figure 2:
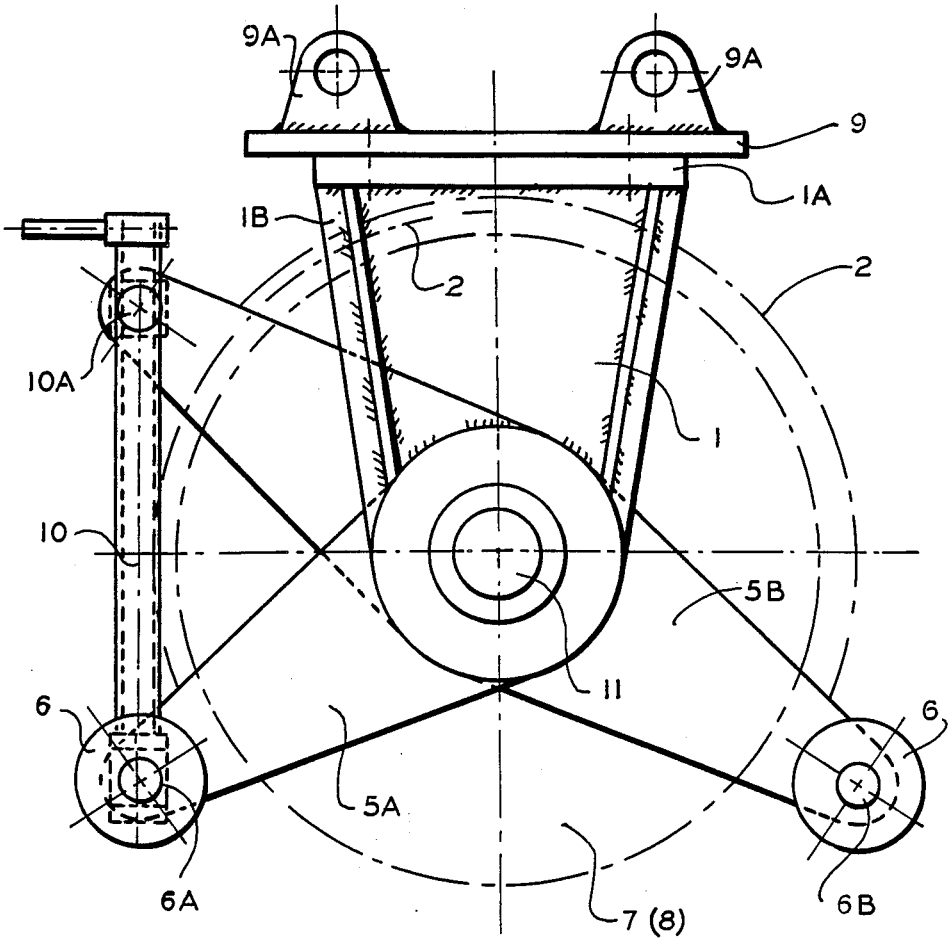
FIG. 2 is an elevational side view of the accessory of FIG. 1.

Referring to FIGS. 1 and 2, frame 1 is a channel-like assembly composed of generally horizontal plate 1A and two reinforced vertical steel plates 1B and 1C. Journalled in coaxial apertures at the lower end of plates 1C and 1B is shaft 11. Shaft 11 is driven by hydraulic motor 4 through planetary transmission 3. Motor 4 and transmission 3 are bolted together, the latter being bolted to the outside of plate 1C. Motor 4 is driven by hydraulic line 4A which may be connected to the hydraulic pump (not shown) of a ground working equipment such as an excavator, a backhoe loader, a loading shovel and the like.

Mounted on shaft 11 is flange 11A. Flange 11A can be fitting with a milling disc 8 having an annular shape with a concentric recess sized to fit flange 11A. The dotted lines embracing the periphery of milling disc 8 indicate the area where cutting tools (described further hereinafter) are located. In this embodiment, milling disc 8 is split so that it can be easily assembled around flange 11A and bolted thereto.

In an alternate configuration also illustrated in FIG. 1, shaft 11 can have mounted on it a pair of spaced flanges such as flange 11B. Drum 7 can be a hollow split cylindrical body which is bolted to the outside face of flanges 11B. The dotted lines embracing the periphery of drum 7 indicate the area in which a plurality of planing tools are located as described hereinafter. It is expected that in some embodiment, the flanges arranged on shaft 11 will be standardized so that either a planing drum or milling disc can be assembled on shaft 11.

Rotatably mounted about shaft 11 within plates 1A and 1B are a pair of identical rocker arms 5B. The length of arms 5B exceed the effective diameter of either disc 8 or drum 7. Rotatably mounted about shaft 11 between arms 5B and frame 1 are a pair of arms 5A. Arms 5A extend essentially only in one radial direction. Each of the pairs of arms 5A and 5B have their lower ends spanned by axles 6A and 6B, respectively. Each outside end of axles 6A and 6B rotatably support rollers 6. Spanning the upper ends of braces 5B is rotatable horizontal beam 10A. Beam 10A and axle 6A are centrally interconnected by jack screw 10 which is threaded through beam 10A and is employed to control cutting depth in a manner described. Rotation of the upper handle of jack screw 10 alters the vertical spacing between beam 10A and axle 6A which consequently changes the angular relationship between arms 5A and 5B.

Arms 5A and 5B together with the jack screw apparatus 10 form a support-depth-control device for the planing drum 7 or milling disc 8. Significantly, arms 5A and 5B will hold a preset angular relationship but will be able to swing around shaft 11. Consequently, the rollers 6 of the assembly can be pressed on a road surface, independent of the position of any boom of an excavator or backhoe loader, while this boom reciprocates from an outwardly extended to an inwardly retracted position.

Bolted to the top of plate 1A is adaptor plate 9 having welded thereto four vertical bearings 9A in the shape of vertical plates having an upper circular aperture bored through each. The positioning of the bearings 9A is chosen to allow connection by two bolts of plate 9 to the boom of an excavator or backhoe loader or the arms of a loading shovel. As previously mentioned, the hydraulic motor of such excavator, backhoe loader or loading shovel can be connected to hydraulic line 4A to power hydraulic motor 4.

Figure 3:
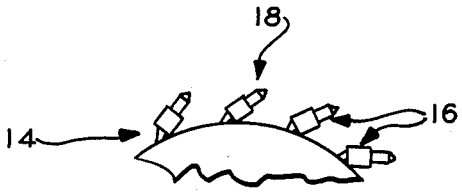
FIG. 3 is a detailed view of the cutting edges of the tools of FIG. 1.

Referring to FIG. 3 the periphery 14 of the milling disc 8 (or planing drum 7) is shown supporting a plurality of angularly spaced tool holders 16 which may be welded to periphery 14. Suitably clamped in tool holders 16 are pointed road planing tools 18 having round shanks. For milling disc 8 the tools 18 will be distributed in the same plane, that is, all in a single row. For planing drum 7, however, a plurality of rows of tools will be employed to allow planing over an extended surface area.

Figure 4:
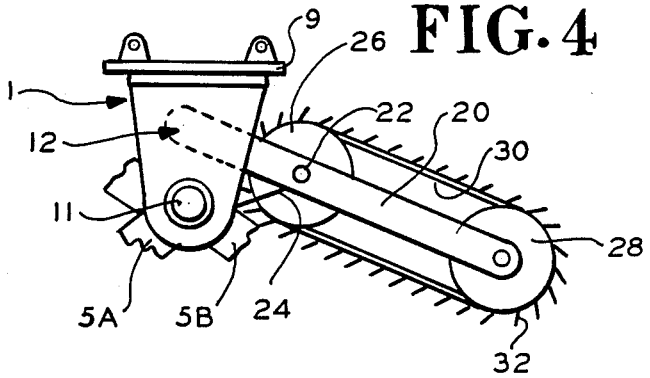
FIG. 4 is an elevational side view of a trencher device attached to the accessory of FIG. 1.

Referring to FIGS. 1 and 4, the attachment points 12 of a trencher device are located on the plates 1B and 1C. The trencher device is shown herein as a boom 20 suitably attached at points 12 of frame 1. Rotatably mounted on boom 20 is a driving shaft 22 which is coupled by chain drive 24 or other mechanical means to shaft 11. Accordingly, the previously mentioned hydraulic motor by turning shaft 11 can also turn drive shaft 22. Mounted on shaft 22 is sprocket 26. The outer end of boom 20 also rotatably supports driven sprocket 28. An endless chain 30 circulates over sprockets 26 and 28. Outwardly projecting from chain 30 are a plurality of cutters 32 which are used to dig a trench.

In order to facilitate an understanding of the principles associated with the foregoing apparatus, its operating will be briefly described. It will be assumed that the apparatus is configured with a planing drum 7, although one or more milling discs can be used instead. Initially, the boom of the excavator or backhoe loader is bolted by means of journals 9A to the apparatus shown in FIG. 1. The boom may then be extended outwardly to the maximum extent and plate 9 set approximately horizontal. The hydraulic pump associated with the boom is connected to hydraulic line 4A to spin hydraulic motor 4. In one constructed embodiment the pressure of line 4A together with the reduction ratio of planetary transmission 3 was such that shaft 11 rotated at a speed of between 100 to 200 revolutions per minute.

Next, the operator causes the boom to press downwardly on plate 9 to firmly seat rollers 6 against the ground surface. Since arms 5A and 5B can swing about shaft 11, they establish the cutting depth without regard to the levelness of plate 9. Thereafter, the boom can be pulled inwardly to its fully retracted position, while keeping the downward pressure on plate 9 to permit planing. During this process arms 5A and 5B remain free to swing around driving shaft 11. With this construction, it is possible to press the planing drum into the road surface with the boom of the backhoe loader and at the same time keep the desired milling depth while the boom is pulled from its maximum reach to a point nearest the backhoe loader. Without this free swinging support-depth-control-device it is not possible to keep during this movement of the boom the wanted depth at an equal level. Of course the depth of the cutting can be adjusted by rotating the upper handle of jack screw 10 to change the angular position of arms 5A and 5B thereby changing the height of shaft 11.

Utility contractors who work with the here described equipment attached to their backhoe loader or excavator can first cut the joints in the road surface, then dig the trench, lay the pipe, refill the trench, bring in the base course, mill on the edges of the joints 10–20 cm wide and 2–3 cm deep (for example) in order to get a better connection between the old and the new layer, and then put in the wearing course. All this can be done with one powered machine when the here described attachment is attached to the backhoe loader or excavator. Cable contractors will not need to cut two joints in foot paths. As noted, many foot paths have only a thin wearing course of about 2 cm. Beneath this wearing course is a base course of 8–10 cm. The here described equipment can with the planing drum, mill in one path the wearing course and the base course up to a depth of 12 cm or more. This is not possible with road planers which are on the market. With the here described equipment attached to an excavator this work can be done because the excavator drives on the road, swings its boom with the here described equipment over the foot-path and mills the asphalt on the foot path. After that the trenching device can be attached to the here described equipment and where the asphalt has been milled now trenching can be done. By milling the asphalt in one pass instead of making two joints with joint cutters there is the further advantage that the asphalt is cut into small pieces which can be used for the new base course.

It is to be appreciated that various modifications may be implemented with respect to the above described preferred embodiment. In constructed embodiments, the milling discs can cut a joint 3 cm wide and up to 15 cm deep. Similarly, it is anticipated that some embodiments will employ a milling drum 20 cm wide and able to cut 10 cm deep. Alternatively, one constructed embodiment employs a drum able to cut 40 cm wide. Of course, other widths and depths can be chosen depending upon the specific application. It will be appreciated that one, two or more milling discs may be secured to shaft 11 by providing an appropriate number of flanges. In one embodiment a pair of joint cutting discs are mounted on a shaft so that a trench can be quickly cut by simultaneously cutting a parallel pair of joints. While in the preferred embodiment, the reduction ratio of the planetary transmission is between 6 to 12, this ratio can be varied depending upon the desired drive speed, tool speed or the motor speed.

Obviously, many modifications and variations of the present invention are possible in light of the above teachings. It is, therefore, to be understood that within the scope of the appended claims, the invention may be practices otherwise than as specifically described.

What is claimed is:

1. A multi-function accessory for the boom or structure of ground or road working equipment, comprising:

a frame;

rotative means for providing rotatable support and mounting in said frame;

a motor mounted on said frame; and at least one of a plurality of functionally different rotary tools for engaging said ground or road, detachably mounted on said rotative means and driven by said motor, said rotative means being adapted to interchangeably support and rotate any one of said plurality of different rotary tools.

2. An accessory according to claim 1 wherein said ground or road working equipment has a hydraulic pump and wherein said motor is connected to said hydraulic pump to be driven thereby.

3. An accessory according to claim 2 wherein one of said plurality of said rotary tools comprises:

a milling disc having on its periphery a plurality of carbide tips for joint cutting in a surface.

4. An accessory according to claim 2 wherein one of said rotary tools comprises:

a planing drum having on its periphery a plurality of carbide tips for planing a surface.

5. An accessory according to claim 1, further comprising:

a trencher device attached to and extending from said frame, said trencher device being powered by said rotative means for digging a trench.

6. An accessory according to claims 1–4 or 5 wherein said rotative means comprises:

a shaft rotatably mounted in said frame.

7. An accessory according to claim 6 further comprising:

a support depth control means swingably suspended about the axis of said shaft for engaging a ground or road surface and controlling the depth to which at least one of said plurality of functionally different tools can be pressed at least by gravity, said support depth control means being operable to swing in response to angular variations in said boom or structure and to variations in said ground or road.

8. A method for using either one of a pair of functionally different rotary tools on a boom or structure of ground or road working equipment having a power source, comprising the steps of:

rotatably attaching a first one of said rotary tools to said boom or structure;

rotating said tool with power from said power source;

adjusting said boom or structure to press at least by gravity said tool against a surface; and replacing said first one of said functionally different rotary tools with a second one of said functionally different rotary tools.

9. A method according to claim 8 further comprising the step of:

moving said first one of said tools with respect to said equipment and along said surface by articulating said boom or structure.

10. An accessory for the boom or structure of ground or road working equipment, comprising:

a frame;

rotative means for providing rotatable support and mounting in said frame wherein said rotative means has an axis;

a motor mounted on said frame;

a joint-cutting saw mounted on said rotative means; and support depth control means swingably suspended about the axis of said rotative means for engaging a ground or road surface and controlling the depth to which said saw can be pressed at least by gravity, said support depth control means being operable to swing in response to angular variations in said boom and to variations in said ground or road.

11. An accessory for the boom or structure of ground or road working equipment, comprising:

a frame;

rotative means for providing rotatable support and mounted in said frame;

a motor mounted on said frame wherein said rotative means has an axis;

a rotary planer mounted on said rotative means; and support depth control means swingably suspended about the axis of said rotative means for engaging a ground or road surface and controlling the depth to which said rotary planer can be pressed at least by gravity, said support depth control means being operable to swing in response to angular variations in said boom and to variations in said ground or road.

12. A multi-function accessory for the boom or structure of ground or road working equipment, comprising:

a frame;

rotative means for providing rotatable support and mounted in said frame, wherein said rotative means has an axis;

a motor mounted on said frame;

at least one of a plurality of functionally different rotary tools detachably mounted on said rotative means and driven by said motor, said rotative means being adapted to interchangeably support and drive any one of said plurality of different rotary tools; and support depth control means swingably suspended about the axis of said rotative means for engaging a ground or road surface and controlling the depth to which at least one of said rotary tools can be pressed at least by gravity, said support depth control means being operable to swing in response to angular variations in said boom and to variations in said ground or road.

13. An accessory according to claim 12 wherein, said ground or road working equipment has an hydraulic pump and wherein said motor is connected to said hydraulic pump to be driven thereby.

14. An accessory according to claim 12, wherein said rotative means comprises a shaft and wherein said support depth control means comprises:

a first and second arm rotatably mounted about said shaft; and adjustment means coupled between said first and second arm for holding an adjustable angle between them.

15. An accessory according to claim 12 wherein said rotative means comprises a shaft and wherein said support depth control means comprises:

a pair of parallel arms rotatably mounted at opposite ends of said shaft, each of said arms having an outer end;

a pair of parallel rockers rotatably mounted at opposite ends of said shaft, each of said rockers having an upper and lower end;

an upper brace mounted between the upper ends of said rockers;

a lower brace mounted between the outer ends of said arms;

a jack screw coupled between said upper and lower brace and rotatable to adjust the spacing between them; and a first and second pair of spaced rollers separately and rotatably mounted to said outer ends and said lower ends, respectively.

16. A method for using either one of a pair of functionally different rotary tools in a boom or structure of ground or road working equipment having a power source, and employing a vertically adjustable roller carriage rotatably suspended about said tool, comprising the steps of:

rotatably attaching a first one of said rotary tools to said boom or structure;

rotating said tool with power from said power source;

adjusting said boom or structure to press at least by gravity said tool against a surface;

moving said first one of said tools with respect to said equipment and along said surface by articulating said boom or structure;

simultaneously pressing at least by gravity said first one of said tools and said roller carriage against a surface with a carriage allowed to swing freely in response to angular variations in said boom and to variation in said ground or road, and with said carriage adjustable to limit the working depth of said first one of said tools; and replacing the first one of said functionally different rotary tools with a second one of said functionally different rotary tools.

17. An accessory for the boom or structure of ground or road working equipment, comprising:

a frame arranged for attachment to said boom or structure;

a shaft rotatably mounted in said frame;

a motor mounted on said frame for rotating said shaft; and a rotary tool mounted on said shaft, said frame including:

depth means for engaging a ground or road surface and controlling the depth to which said tool can be pressed at least by gravity, said depth means including a pair of angularly and relatively adjustable members, at least one of them being operable to swing and vary its angle of elevation independently of that of said boom or structure; and separation means for adjustably holding said members at an adjustable, relative angle.

18. An accessory for the boom or structure of ground or road working equipment comprising:

a frame arranged for attachment to said boom or structure;

a shaft rotatably mounted in said frame;

a motor mounted on said frame for rotating said shaft;

a rotary milling tool mounted on said shaft; and a support depth control means for engaging a ground or road surface and controlling the depth to which said rotary milling tool can be pressed at least by gravity, said support depth control means comprising:

(a) separation means having a pair of members with an adjustable separation; and (b) a pair of relatively movable ends, each of said movable ends being attached to a corresponding one of said pair of members, said movable ends being operable to move around a common pivot point and be that lifting or lowering the shaft with the milling tool in relation to the

19. An accessory for the boom or structure of ground or road working equipment, comprising:

a frame arranged for attachment to said boom or structure;

a shaft rotatably mounted in said frame;

a motor mounted on said frame for rotating said shaft;

a rotary milling tool mounted on said shaft; and a support depth control means for engaging a ground or road surface and controlling over a predetermined adjustable range the depth to which said rotary milling tool can be pressed at least by gravity, said support depth control means comprising:

a support means having front and rear support for supporting the accessory both in front of and behind the shaft if pressed at least by gravity on the surface, once adjusted said support depth control means being operable to hold constant the radial spacing from said shaft to said front support and to said rear support.

20. An accessory for the boom or structure of ground or road working equipment, comprising:

a shaft;

a motor coupled to said shaft for rotating it;

a rotary milling tool mounted on said shaft;

a frame arranged for attachment to said boom or structure, said shaft being rotatably mounted in said frame, said frame including: (a) a primary member; and (b) a support depth appendage mounted from said primary member to articulate therefrom, said frame being operable to engage a ground or road surface for controlling the depth to which said rotary milling tool can be pressed at least by gravity, said frame being sized and shaped to engage said surface; and a separation means coupled between said primary member and said appendage to move said appendage in a scissor-like fashion to change the milling depth of said tool.

21. An accessory for the boom or structure of ground or road working equipment comprising:

a frame arranged for attachment to said boom or structure;

a shaft rotatably mounted in said frame;

a motor mounted on said frame for rotating said shaft;

a rotary milling tool mounted on said shaft; and a support depth control means for engaging a ground or road surface and controlling the depth to which said rotary milling tool can be pressed at least by gravity, said support depth control means comprising:

(a) separation means having a pair of members with an adjustable separation; and (b) a support having a forward end and an aft end, said support being coupled to one of said members, the other member being adapted to allow the shaft and milling tool to be lowered or lifted in relation to the surface, once adjusted said separation means being operable to hold constant the radial spacing from said shaft to said forward end and to said aft end.

* * * * *